US006739691B2

(12) United States Patent
Walker

(10) Patent No.: US 6,739,691 B2
(45) Date of Patent: May 25, 2004

(54) METHOD AND APPARATUS FOR PREVENTING THEFT OF REPLACEABLE PRINTING COMPONENTS

(75) Inventor: Ray A. Walker, Eugene, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/446,397

(22) Filed: May 28, 2003

(65) Prior Publication Data

US 2003/0206215 A1 Nov. 6, 2003

Related U.S. Application Data

(63) Continuation of application No. 09/967,821, filed on Sep. 28, 2001.

(51) Int. Cl.[7] ..... B41J 29/393

(52) U.S. Cl. ..... 347/19; 340/568.1; 399/12

(58) Field of Search ..... 347/19, 50; 340/568.1, 340/572.1; 399/12, 13

(56) References Cited

U.S. PATENT DOCUMENTS

| | | | | |
|---|---|---|---|---|
| 723,188 | A | | 3/1903 | Tesia |
| 3,713,148 | A | | 1/1973 | Cardullo et al. |
| 5,049,898 | A | | 9/1991 | Arthur et al. |
| 5,398,257 | A | | 3/1995 | Groenteman |
| 5,567,063 | A | | 10/1996 | Chiu |
| 6,065,824 | A | | 5/2000 | Bullock et al. |
| 6,106,166 | A | | 8/2000 | Spurr et al. |
| 6,267,463 | B1 | | 7/2001 | Paulsen et al. |
| 6,271,928 | B1 | | 8/2001 | Bullock et al. |
| 6,324,351 | B1 | | 11/2001 | Kurimoto et al. |
| 6,333,692 | B1 | | 12/2001 | Anderson et al. |
| 6,351,621 | B1 | | 2/2002 | Richards et al. |
| 6,366,742 | B1 | | 4/2002 | Reihl et al. |
| 6,497,361 | B1 | | 12/2002 | Mason |
| 2002/0015066 | A1 | | 2/2002 | Siwinski et al. |
| 2002/0038222 | A1 | * | 3/2002 | Naka ..... 705/1 |
| 2002/0161651 | A1 | | 10/2002 | Godsey et al. |

FOREIGN PATENT DOCUMENTS

| | | |
|---|---|---|
| EP | 940259 A2 | 8/1999 |
| EP | 940258 A1 | 9/1999 |
| EP | 1088667 A1 | 4/2001 |
| WO | WO00/19278 A | 4/2000 |

OTHER PUBLICATIONS

1) Working Knowledge by Joseph Ryan, Jr., 1997 by Scientific American, Inc. 2) Check/point Inventory Protection and Management Systems by Check/point Systems Inc.

* cited by examiner

*Primary Examiner*—Juanita Stephens
*Assistant Examiner*—Blaise Mouttet

(57) ABSTRACT

The present disclosure relates a marking engine for use in a marking machine. The marking engine is responsive to control signals for selectively depositing marking material on media. The marking engine includes a housing associated with the marking engine. The housing is configured for docking with the printing system. Also included is a radio frequency linking device mounted to the housing for providing a radio frequency link for transferring information between the marking engine and surveillance devices different from the marking machine.

28 Claims, 6 Drawing Sheets

METHOD AND APPARATUS FOR PREVENTING THEFT OF REPLACEABLE PRINTING COMPONENTS

This is a continuation of application Ser. No. 09/967,821, filed Sep. 28, 2001.

BACKGROUND OF THE INVENTION

The present invention relates to printing systems that make use of a replaceable printing component. More particularly, the present invention relates to replaceable printing components that include a radio frequency linking device for providing information relating to the replaceable printing component.

In the case where the printing system is an ink jet printing system, an ink-jet printhead is frequently mounted within a carriage that is moved back and forth across a print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system to not move with the carriage. For the case where the ink supply is not carried with the carriage, the ink supply can be intermittently or continuously connected to the printhead for replenishing the printhead. In either case, the replaceable printing components, such as the ink container and the printhead, require periodic replacement. The ink supply is replaced when exhausted. The printhead is replaced at the end of printhead life.

In the case where the printing system is an electrophotographic printing system, the replaceable consumable is typically the electrophotographic engine frequently referred to as a toner cartridge. The toner cartridge often includes an intermediate imaging device such as a drum and an imaging material such as toner. The drum is charged using an energy source such as a scanning laser. The imaging material is attracted to the charged drum and is then transferred to print media. The replaceable printing component is either a supply of imaging material or the entire toner cartridge.

These replaceable printing components are often sold through retail sales channels. Because of the relatively high cost of these replaceable printing components they pose a theft risk to retailers. There is an ever present need for techniques for preventing theft from retailers. These techniques should be difficult for thieves to defeat. In addition, these techniques should be reliable and result in relatively little additional costs to the retailers.

SUMMARY OF THE INVENTION

One aspect of the present disclosure is a marking engine for use in a marking machine. The marking engine is responsive to control signals for selectively depositing marking material on media. The marking engine includes a housing associated with the marking engine. The housing is configured for docking with the printing system. Also included is a radio frequency linking device mounted to the housing for providing a radio frequency link for transferring information between the marking engine and surveillance devices different from the marking machine.

Another aspect of the present disclosure is a replaceable printing component for insertion into a printing system. The replaceable printing component includes a radio frequency linking device for transferring information between the replaceable printing component and the printing system, wherein the radio frequency linking device is configured for transferring information between the replaceable printing component and electronic surveillance systems.

DETAILED DESCRIPTION OF THE PREFERRED EMBODIMENT

Figure 1:
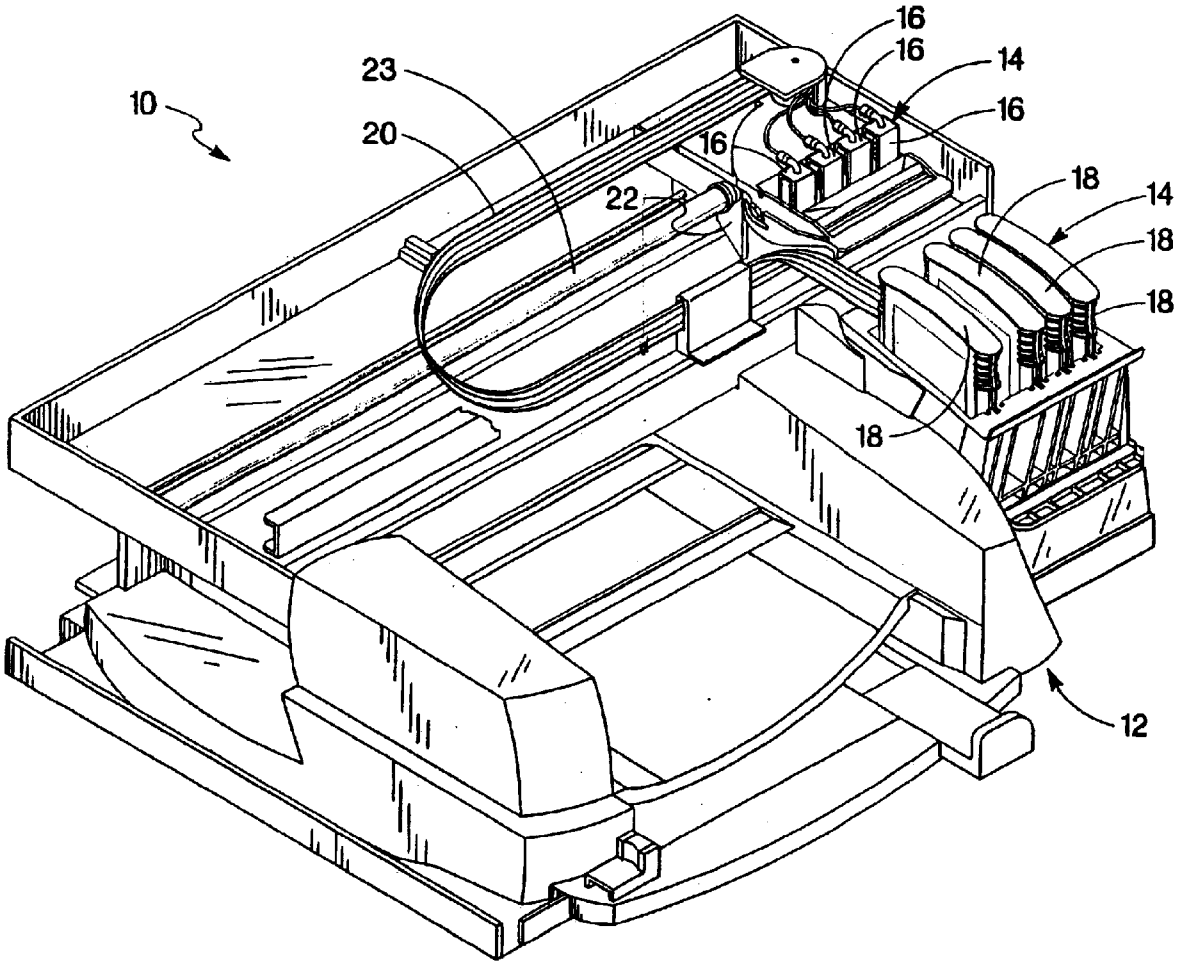
FIG. 1 depicts a perspective view of an exemplary printing system, shown with the cover removed, that incorporates replaceable printing components of the present invention.

FIG. 1 is a perspective view of one exemplary embodiment of an ink-jet printing system 10 of the present invention shown with its cover removed. The ink-jet printing system 10 includes a printer portion 12 having a plurality of replaceable printing components 14 installed therein. The plurality of replaceable printing components 14 include a plurality of printheads 16 for selectively depositing ink in response to control signals and a plurality of ink containers 18 for providing ink to each of the plurality of printheads 16. Each of the plurality of printheads 16 is fluidically connected to each of the plurality of ink containers 18 by a plurality of flexible conduits 20.

Each of the plurality of printheads 16 is mounted in a scanning carriage 22. The scanning carriage moves on a carriage support rod 23 to scan past a print media (not shown) as the print media is stepped through a print zone. As the plurality of printheads are moved relative to the print media, ink is selectively ejected from a plurality of orifices in each of the print plurality of the printheads 16 to form images and text.

One aspect of the exemplary embodiment disclosed is a method and apparatus for transferring information between the replaceable printing components 14 and the printer portion 12. An electrical storage device is associated with each of the replaceable printing components 14. The electrical storage device contains information related to the particular replaceable printer component 14. Installation of the replaceable printing component 14 into the printer portion 12 allows information to be transferred between the electrical storage device and the printing portion 12 to ensure proper operation of the printing system 10. The information provided from the replaceable printing component 14 to the printing portion 12 tends to prevent operation of the printing system 10 in a manner which damages the printing system 10 or which reduces the print quality. Another aspect of the exemplary embodiment disclosed is the technique for transferring information from the replaceable printing component 14 and an electronic surveillance system. Configuring the replaceable printing component 14 to transfer information to both the printing system 10 and the electronic surveillance systems allows retail sales outlets to use this feature to prevent theft of the replaceable printing component 14. The replaceable printing component 14 of this exemplary embodiment will be discussed in more detail with respect to FIGS. 2–6.

Although the exemplary printing system 10 shown in FIG. 1 makes use of ink containers 18 which are mounted off of the scanning carriage 22, the technique of the present disclosure is equally well suited for other types of printing system configurations. One such configuration is one where the replaceable ink containers 18 are mounted on the scanning carriage 22. Alternatively, the printhead 16 and the ink container 18 may be incorporated into an integrated printing cartridge that is mounted to the scanning carriage 22. The printing system 10 is alternatively an electrophotographic printing system 10 that makes use of a replaceable consumable. 14 that is a replaceable toner cartridge. Upon installation of the toner cartridge, information is transferred between an electrical storage device on the toner cartridge and the printer portion 12 that receives the toner cartridge. The printing system 10 of the present invention may be used in a wide variety of applications such as facsimile machines, postal franking machines and large format type printing systems suitable for use in displays and outdoor signage, to name a few.

Figure 2:
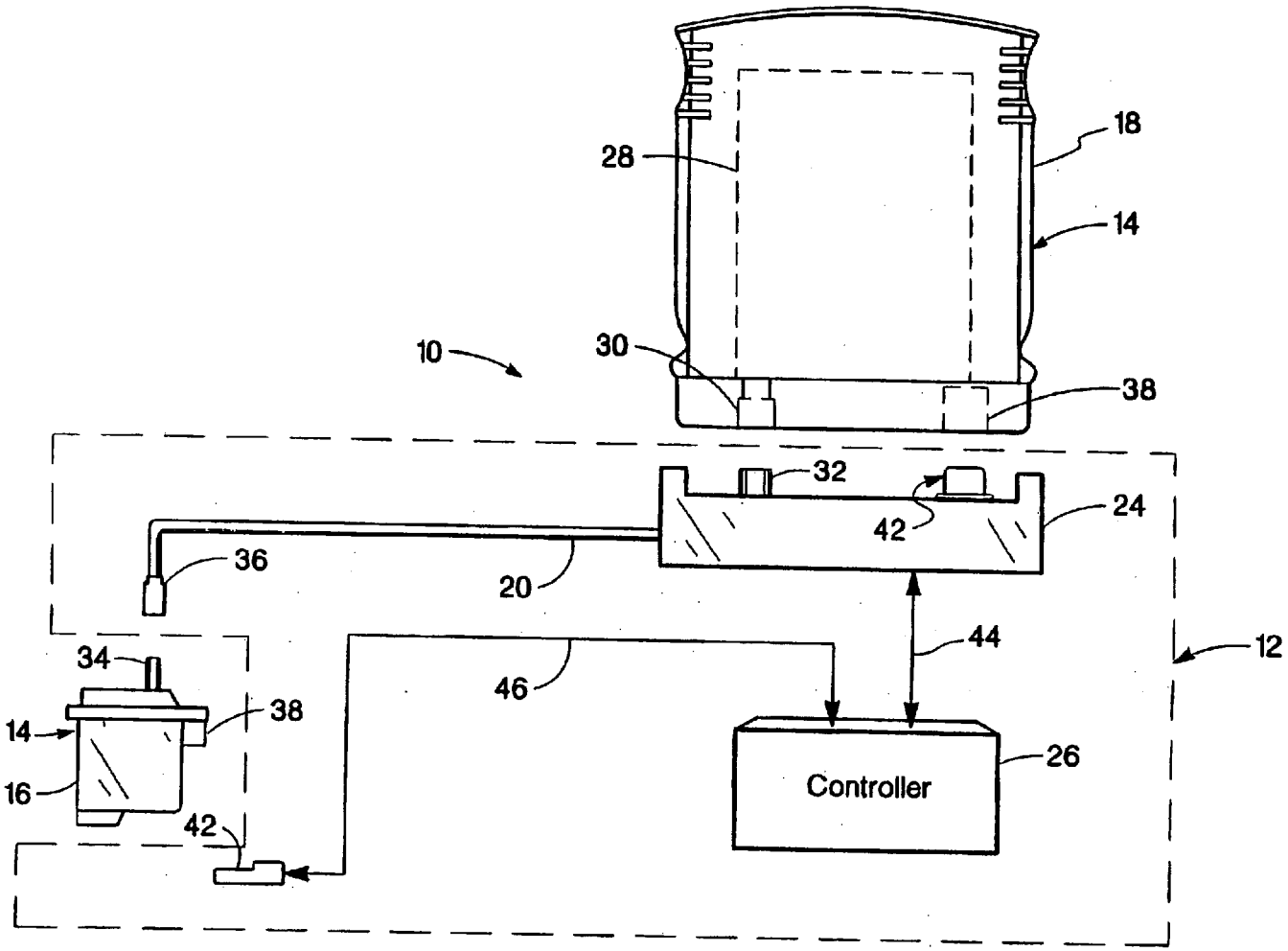
FIG. 2 depicts a schematic representation of the printing system shown in FIG. 1 illustrating a replaceable ink container and printhead each of which contain a linking device for transferring information between the replaceable printing components and printer portion.

FIG. 2 depicts a simplified schematic representation of the exemplary ink-jet printing system 10 shown in FIG. 1. FIG. 2 is simplified to illustrate a single printhead 16 and a single ink container 18 for accomplishing the printing of a single color. For the case where more than one color is desired a plurality of printheads 16 are typically used with each printhead 16 having an associated ink container 18.

The ink-jet printing system 10 of the present invention includes a printer portion 12 having replaceable printing components 14. The replaceable printing components 14 include a printhead 16 and an ink container 18. The printer portion 12 includes an ink container receiving station 24 and a controller 26. With the ink container 18 properly inserted into the ink container receiving station 24, a fluidic coupling is established between the ink container 18 and the printer portion 12. The fluidic coupling allows ink stored within the ink container 18 to be provided to the printhead 16.

The ink container 18 includes a reservoir 28 for storing ink therein. A fluid outlet 30 is provided that is in fluid communication with the fluid reservoir 28. The fluid outlet 30 is configured for connection to a complimentary fluid inlet 32 associated with the ink container receiving station 24.

The printhead 16 includes a fluid inlet 34 configured for connection to a complimentary fluid outlet 36 associated with the printing portion 12. With the printhead 16 properly inserted into the scanning carriage 22 (shown in FIG. 1) fluid communication is established between the printhead and the ink container 18 by way of the flexible fluid conduit 20.

Each of the replaceable printing components 14 such as the printhead 16 and the ink container 18 include a linking device 38 such as a radio frequency linking device. Associated with each of the linking devices 38 is an electrical storage device or memory for storing information related to the respective replaceable printer component 14. A corresponding linking device 42 is associated with the printer portion 12 for exchanging information with the corresponding linking device 38 associated with the replaceable printing component.

An information link is selectively established between the printer portion 12 and each of the replaceable printing components such as the printhead 16 and ink container 18. The information link allows information to be passed between the printer portion 12 and each of the printhead 16 and the ink container 18 to ensure the operation of the printer portion 12 is compatible with the ink contained in the ink container 18 and the printhead 16 thereby achieving high print quality and reliable operation of the printing system 10.

With the ink container 18 properly inserted into the ink container receiving station 24 the linking device 38 is disposed and arranged relative to the linking device 42 associated with the printer portion 12 to allow information to be passed between linking device 42 and linking device 38 without direct electrical contact. Similarly, with the printhead 16 properly inserted into a corresponding printhead receiving station (not shown) the linking device 38 is disposed and arranged relative to the linking device 42 to allow information to be passed between linking device 42 and linking device 38 without direct electrical contact.

The controller 26 controls the transfer of information between the printer portion 12 and each of the printhead 16 and the ink container 18. In addition, the controller 26 controls the relative movement of the printhead 16 and the print media, as well as selectively activating the printhead to deposit ink on the print media.

Although linking devices 38 associated with each of the ink container 18 and the printhead 16 are given the same element number to indicate these devices are similar devices, the information stored in the electrical storage device associated with the ink container 18 will, in general, be different from the information stored in the electrical storage device associated with the printhead 16. Similarly, the information stored in electrical storage device associated with each ink container of the plurality of ink containers 18 will in general be different and unique to be particular ink container of the plurality of ink containers 18.

Figure 3:
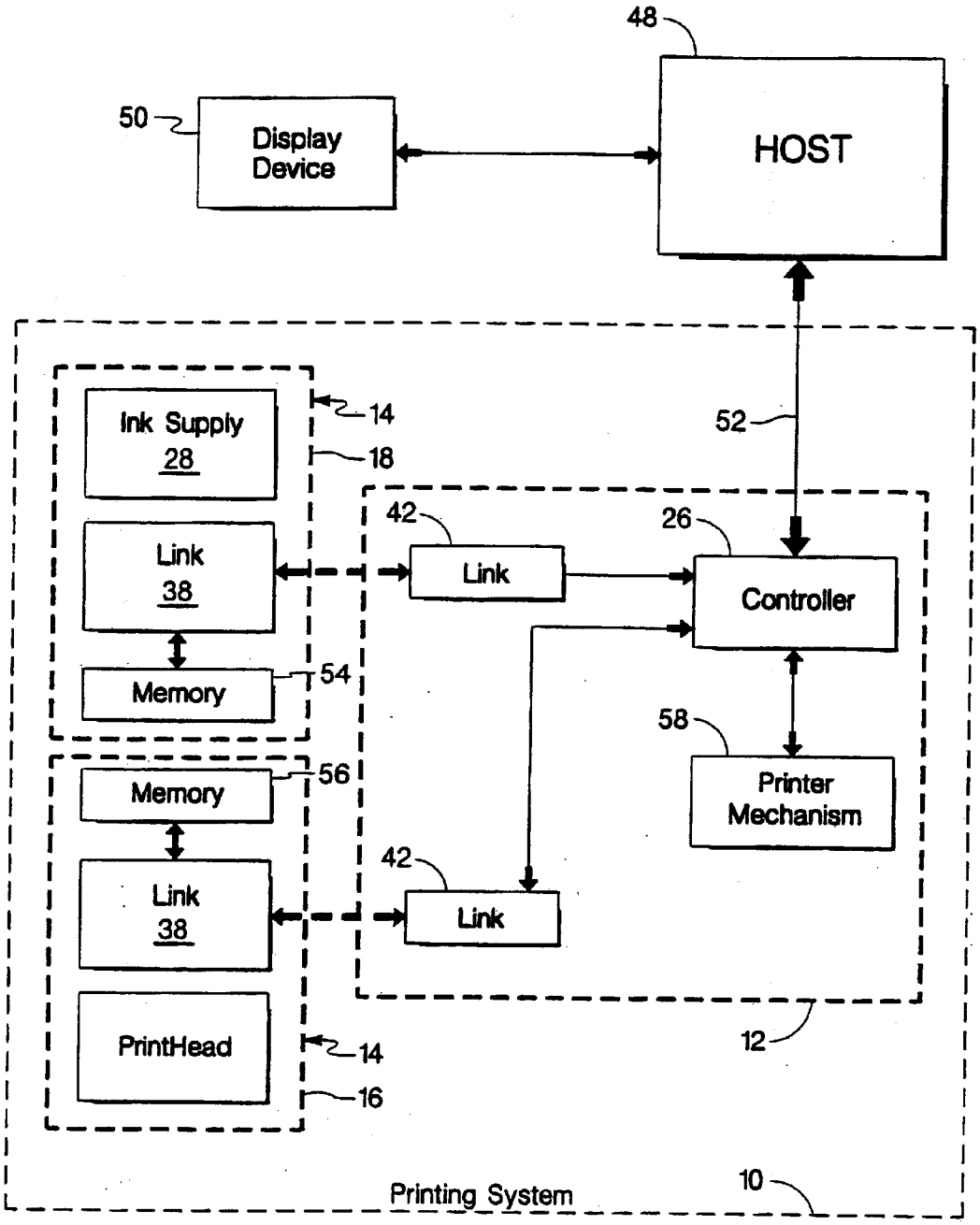
FIG. 3 depicts a schematic block diagram of the printing system of FIG. 1 shown connected to a host and which includes a replaceable ink container and printhead each of which contain the linking device.

FIG. 3 represents a simplified block diagram of the printing system 10 of the present invention shown connected to an information source or host computer 48. The host computer 48 is shown connected to a display device 50. The host computer 48 can be a variety of information sources such as a personal computer, work station, or server to name a few, that provides image information to the controller 26 by way of a data link 52. The data link 52 may be any one of a variety of conventional data links such as an electrical link or an infrared link for transferring information between the host computer 48 and the printing system 10.

Information is transferred between the controller 26 and an electrical storage device or memory 54 associated with the ink container 18 by way of linking devices 42 and 38. Similarly, information is transferred between the controller 26 and an electrical storage device or memory 56 associated with the printhead 16 by transferring information between linking devices 42 and 38. In addition, the controller 26 is electrically connected to a printer mechanism 58 for controlling media transport and movement of the carriage 22. The controller 26 makes use of parameters and information provided by the host computer 48, the memory 54 associated with the ink container 18 and memory 56 associated with the printhead 16 to accomplish printing.

The host computer 48 provides image description information or image data to the printing system 10 for forming images on print media. In addition, the host computer 48 provides various parameters for controlling operation of the printing system 10, which is typically resident in printer control software typically referred to as the "print driver". In order to ensure the printing system 10 provides the highest quality images it is necessary that the operation of the controller 26 compensate for the particular replaceable printer component 14 installed within the printing system 10. It is the electrical storage devices 54 and 56 that are associated with the ink container 18 and printhead 16, respectively, that provide parameters which are utilized by the controller 26 to ensure the reliable operation of the printing system 10 and ensure high quality print images.

Among the parameters, for example, which are stored in electrical storage device 54 associated with the replaceable printing component 14 are the following: actual count of ink drops emitted from the printhead 16; a date code associated with the ink container 18; date code of initial insertion of the ink container 18; printing system 10 coefficients; ink type/color; ink container 18 size; age of the ink; printer model number or identification number, and cartridge usage information, just to name a few parameters.

Although the linking devices 38 and 42 of the exemplary embodiment are described herein in the context of an ink jet printing systems this is intended as an example only and not intended to limit the scope of Applicants' invention. The linking devices 38,42 of the present invention are equally well suited to other printer technologies such as electrophotographic printers referred to as laser printers. For electrophotographic printers the linking device 38 is placed on one or more replaceable printing components 14 such as a toner cartridge, a toner container or a replaceable motor, just to name a few. These replaceable printing components 14 are components that are replaceable because they are depleted, have a limited useful life or are specific to a certain type of printing or print media. Some examples of specific types of printing that can require a change in replaceable printing components 14 are color printing, black and white printing, plain paper printing, transparency printing, just to name a few.

The replaceable printing component 14 is alternatively a refurbished replaceable printing component 14. A refurbished replaceable printing component 4814 has been reconditioned or refilled with a replacement ink or replacement marking media. The memory 54 is either refurbished or replaced to allow it to provide signals that enable printing with printing system 10. The memory 54 is refurbished to include, among other things, marking material-related information that is indicative of an amount or type of replacement marking media.

Figure 4:
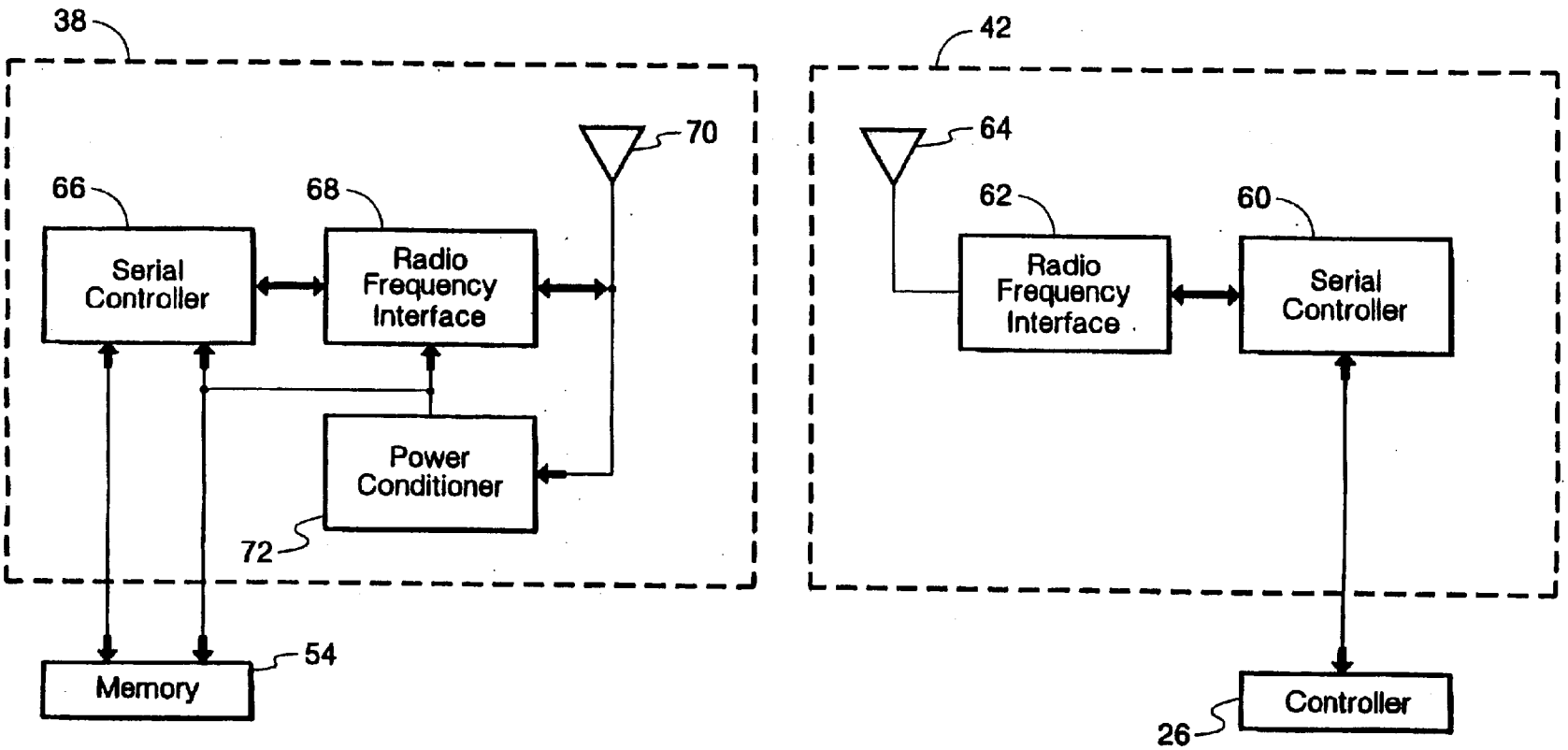
FIG. 4 depicts a schematic representation of the linking devices associated with each of the replaceable printing component and the printing system.

FIG. 4 depicts further detail of the linking devices 38 and 42 of the exemplary embodiment for transferring information between the ink container 18 and the printer portion 12. The linking device 38 associated with the printhead 16 is similar to the linking device 38 associated with the ink container 18 and therefore will not be discussed in detail.

The linking device 42 associated with the printer portion 12 includes a serial controller 60, a radio frequency interface 62 and an antenna 64. The serial controller 60 controls the transfer of information between and the controller 26 associated with the printer portion 10 and the radio frequency interface 62. The serial controller 60 is a microprocessor or a hardware implemented controller that performs all of the necessary interface and data manipulation functions for passing information between the controller 26 and the radio frequency interface 62. One example of this data manipulation is to receive data in a parallel format from the controller 26 and provide the received data in a serial format to the radio frequency interface 62.

The radio frequency interface 62 receives information from the serial controller 60 in a serial fashion and converts this information into a time varying voltage at the antenna 64. This time varying voltage is preferably in a standard radio frequency range such as from 125 kilohertz to 13.56 megahertz. Radio frequencies outside of this range may also be suitable. Transmission of information using a radio frequency technology is used in financial transaction cards provided by financial institutions for financial transactions. These financial transaction cards are sometimes referred to as "smart cards". Similar technology is also used in inventory systems that are sometimes referred to as radio frequency identification technology (RFID).

The linking device 38 associated with the ink container 18 is similar to the linking device 42 associated with the printer portion 12. Similar numbers will be used to identify features of the linking device 38 that are similar to the features of the linking device 42. The linking device 38 includes a serial controller 66, a radio frequency interface 68 and an antenna 70. Provided the antenna 70 associated with linking device 38 is within range of the antenna 64 associated with the linking device 42, voltages are induced on antenna 70 in response to time varying voltages at antenna 64. Information is extracted from the time varying voltages induced on antenna 70 by the radio frequency interface 68. The information is passed from the radio frequency interface 68 to the serial controller 66. In response to command information, the serial controller 66 either stores information in the memory device 54 or retrieves information from the memory device 54 for sending this information to the controller 26 in a process similar to the transfer of information from the controller 26 to the serial controller 60.

The linking device 38 and memory 54 is either powered by an active device such as a battery or by a passive device that stores energy in a storage device such as a capacitor. The energy is provided to the capacitor by voltages induced on the antenna 70. In the preferred embodiment, voltages are induced on the antenna 70 due to time-varying voltages that are applied to antenna 64 by the radio frequency interface 62. The induced voltage at antenna 70 is provided to a power conditioner 72, which converts these time varying voltages into a single polarity voltage that is suitable as a supply voltage for each of the memory 54, serial controller 66, and radio frequency interface 68. In one preferred embodiment the power conditioner 72 rectifies a time-varying voltage that is induced on antenna 70 and filters this rectified voltage to provide a suitable supply voltage. The use of a power conditioner 72 on the linking device 38 eliminates the need for a direct power and ground connection between the replaceable printing component 14 and the printing system 10.

In the case of a passive linking device 38, a time varying electro-magnetic field induces a voltage on antenna 70 to power this device. The modulation of this time varying electromagnetic field allows information to be transferred to the linking device 38. For example, a carrier signal can be provided by the linking device 42 to induce a time varying voltage at antenna 70. This time varying voltage is rectified and filtered by the power conditioner 72 to provide a supply voltage to the linking device 38 and memory 54. The radio frequency interface 62 modulates the carrier signal such as by varying the frequency, phase or amplitude to transmit information to the linking device 38. Demodulation of the carrier signal allows the radio frequency interface 68 to extract information from the carrier signal.

Conversely, information is transferred from the linking device 38 back to the linking device 42. In the exemplary embodiment, information is transferred by changing a load on antenna 70 by the linking device 38. This time varying load on antenna 70 is reflected on the antenna 64 associated with linking device 42 to produce a signal. Information is extracted from the signal on antenna 64 by the linking device 42 to accomplish information transfer from the linking device 38 back to the linking device 42.

Figure 5:
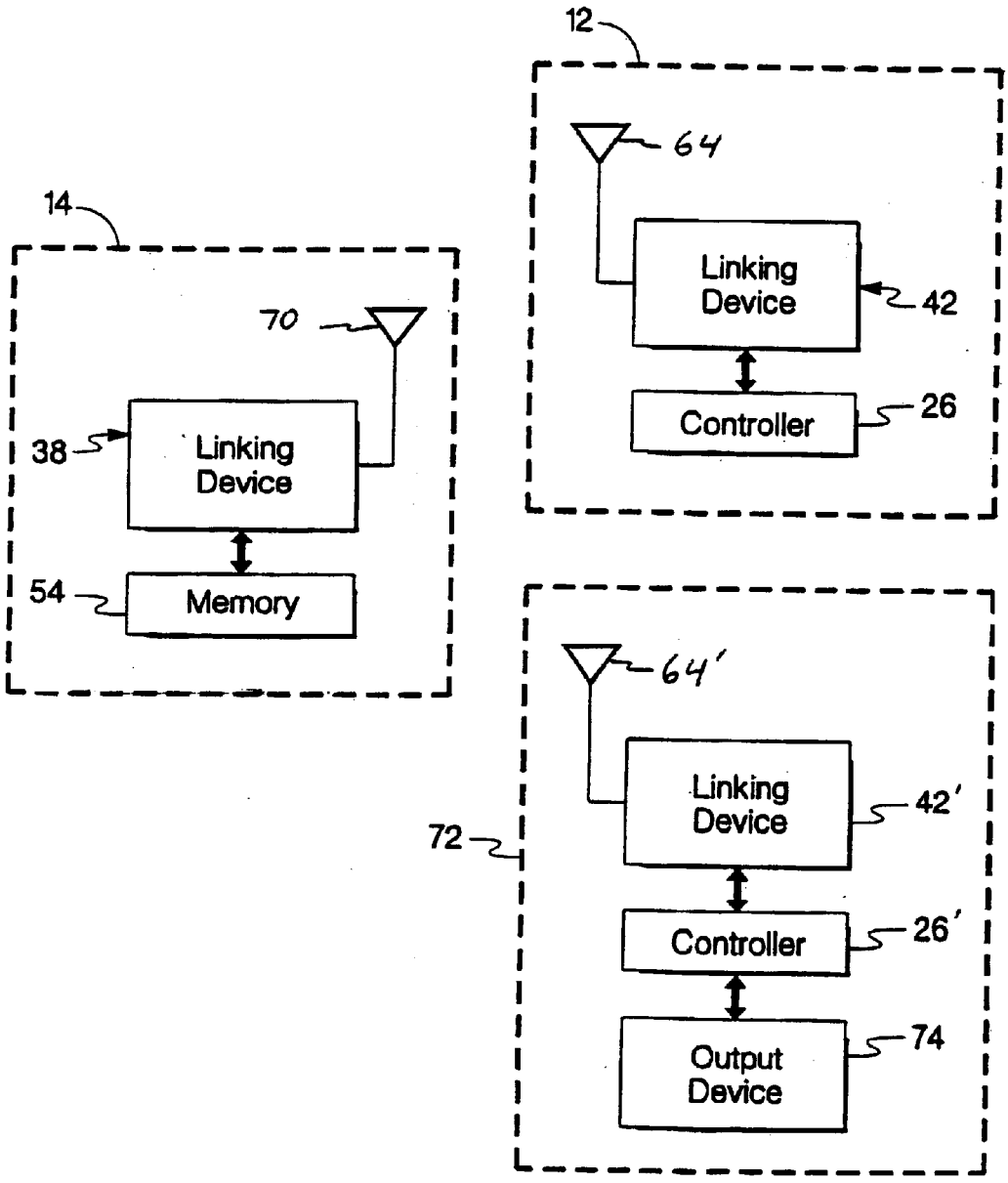
FIG. 5 depicts a schematic representation of the replaceable printing component for transferring information to each of the printing system and article surveillance systems.

FIG. 5 is a block diagram of the linking device 38 on the replaceable printer component 14 and the linking device 42 on the printing system 10 similar to the configuration shown in FIG. 4. However, in addition to the configuration from FIG. 4 an additional electronic surveillance system 72 is shown for communicating with the replaceable printer component 14. In the exemplary embodiment, the electronic surveillance system communicates with the replaceable printing component 14 in a manner similar to the method of communication between the replaceable printing component 14 and the printing system 12, previously discussed with respect to FIG. 4.

The linking device 38 on the replaceable printing component 14 is capable of passing information between both the printing system 12 and the electronic surveillance system 72. Configuring the linking device 38 on the replaceable printing component 14 to commnunicate with both the printing system 12 and the electronic surveillance system 72 allows the linking device 38 to be utilized for preventing theft of the replaceable printing component 14. Because the replaceable printing components 14 are relatively expensive, theft of these components is a significant problem.

The electronic surveillance system 72, in the exemplary embodiment, includes system components that are similar to the system components associated with the printing system 12 and therefore will be designated similar to their corresponding components in the printing system 12. The electronic surveillance system 72 includes a linking device 42' that is similar to the linking device 42 on the printing system 12. The linking device 42' provides a radio frequency signal on an antenna 64' that induces a time varying signal on antenna 70. The time varying signal on antenna 70 is provided to the linking device 38 on the replaceable printing component 14.

In response to receiving a radio frequency signal from the electronic surveillance system 72, the linking device 38 sends information from memory 54 to the linking device 42'. Information is transferred by changing a load on antenna 70 by the linking device 38. This time varying load on antenna 70 is reflected on the antenna 64' associated with linking device 42' to produce a signal. Information is extracted from the signal on antenna 64' by the linking device 42' to accomplish information transfer from the linking device 38 to the linking device 42'. A controller 26' selectively activates an output device 74 if information sent from the replaceable printing component 14 is received.

The linking device 38 on the replaceable printing component 14 may respond to the radio frequency signals at the same frequency for each of the printing system 12 and the surveillance system 72. Alternatively, the linking device 38 may respond to different frequencies depending on whether the printing system 12 or the surveillance system 72 is active.

The linking device 38 on the replaceable printing component 14 can be selectively inactivated. When inactivated the linking device 38 does not respond to radio frequency signals sent by either the electronic surveillance system 72 or the printing system 12. Responses to the electronic surveillance system 72 and the printing system 12 can be individually inactivated. The linking device 38 is inactivated by the receipt of a radio frequency inactivation signal.

An electronic security system 72 such as described in FIG. 5 in an exemplary embodiment is disposed proximate an exit door of a retail sales store. As the replaceable component 14 passes through the exit of the retail sales store, the electronic surveillance system 72 provides a radio frequency signal to the linking device. The linking device 38 on the replaceable printing component 14, if activated, responds by providing a variation in radio frequency signal reflected to the antenna 64' associated with linking device 42'. The controller 26' provides the information to the output device 74 that is indicative that a responsive radio frequency signal has been received by the electronic surveillance system.

Replaceable printing components 14 that are properly purchased are inactivated by the sales clerk as will be discussed in FIG. 6. Replaceable printing components 14 that have not been properly purchased, are not inactivated and hence will activate the output device 74 when passing through the exit of the retail sales outlet. Articles that have properly been inactivated by the sales clerk can pass through the exit without setting off the output device 74.

Figure 6:
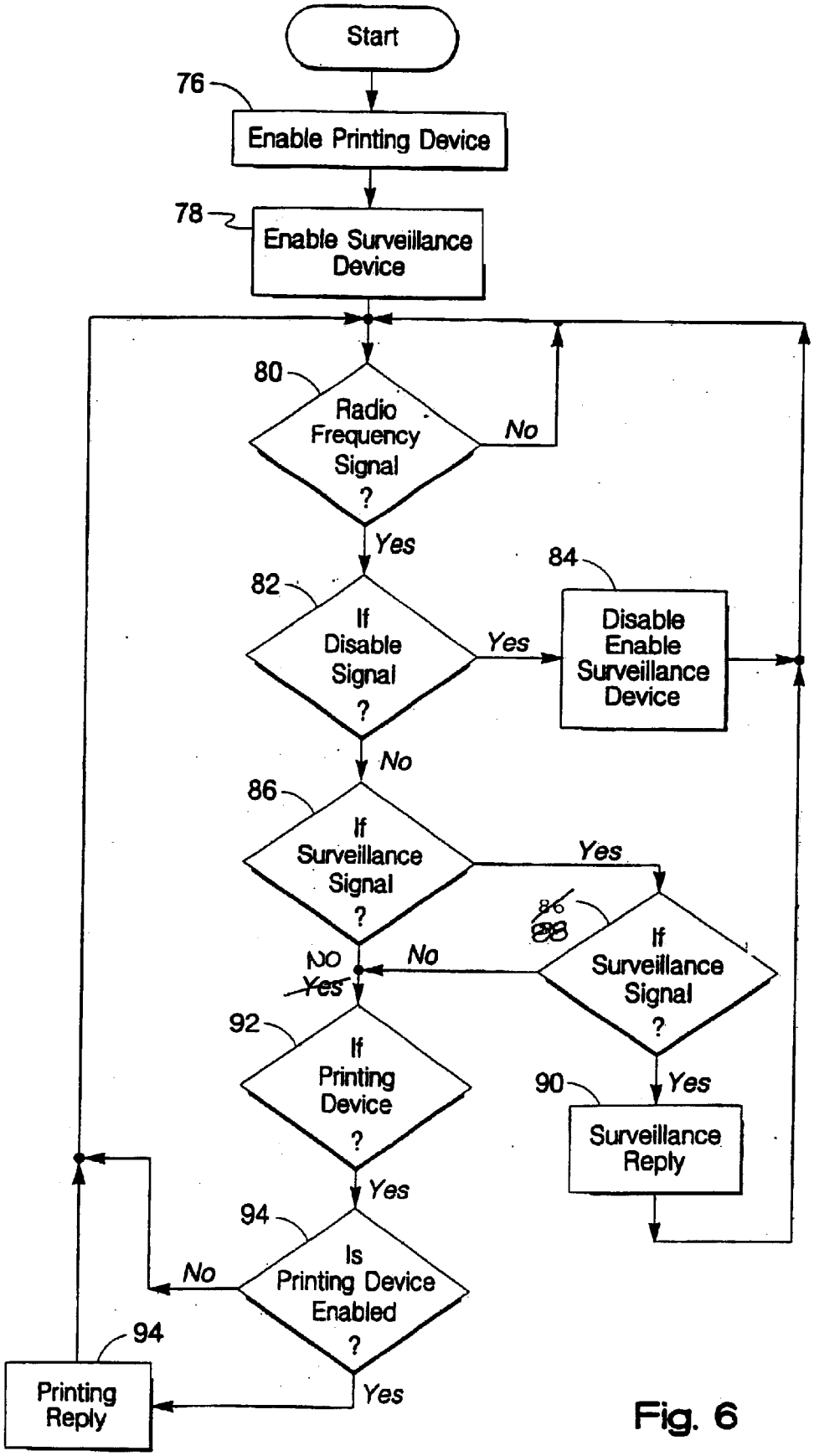
FIG. 6 depicts a method of the present disclosure for transferring information to each of the printing system and article surveillance systems.

FIG. 6 is a flow diagram illustrating a method of the exemplary embodiment shown in FIG. 5 for allowing the replaceable printing component 14 to selectively pass information between the printing system 12 and the electronic article surveillance system 72. The linking device 38 on the replaceable printing component 14 is enabled to exchange information with the printing system 12 as represented by a step 76. Similarly, the linking device 38 is enabled to exchange information with the electronic surveillance system 72 as represented by a step 78. Enabling the linking device 38 to exchange information with each of the printing system 12 and the surveillance system 72 can be accomplished at the manufacturer or some point in the distribution prior to receipt by the retail sales outlet.

If the replaceable printing component 14 receives a radio frequency as represented by step 80, the response of the linking device 38 will depend on whether that radio frequency signal is a disable signal as represented by step 82, a signal from a surveillance system 72 represented by step 86 or a signal from a printing system 12 represented by step 92. Each of the different sources of the radio frequency signal and corresponding response of the replaceable printing component 14 will be discussed.

If the radio frequency signal is a disable signal as represented by step 82 then the linking device 38 is disabled from responding to the corresponding device. For example, the linking device can be disabled from responding to either the electronic surveillance system 72 or printing system 12. In the exemplary embodiment, only the response to the electronic surveillance system 72 is disabled upon a disable signal as represented by step 84. The disable signal in the exemplary embodiment is provided to the replaceable printing component 14 when the replaceable printing component 14 is purchased. Disabling the replaceable printing component 14 from responding to the electronic surveillance system 72 allows the customer to exit the store without activating the output device 74.

If the radio frequency signal is from the surveillance system 72, as represented by step 86, the linking device 38 checks to see if it is enabled to respond or exchange information with the surveillance system 72 as represented by step 88. If the linking device 38 on the replaceable printing component 14 is enabled to respond to the surveillance device 72, the linking device 38 provides a radio frequency signal that is received by the linking device 42' on the surveillance system 72 as represented by step 90. The output device 74 then indicates that someone is attempting to exit the retail outlet without properly paying for the replaceable printing component 14.

If the radio frequency signal received by the linking device 38 on the replaceable printing component 14 is from the printing system 12 as represented by step 92, then the linking device 38 checks to see if the communication with a printing system 12 is enabled as represented by step 94. If communication with a printing system 12 is enabled, then the linking device 38 on the replaceable printing component 14 begins communication with the printing system 12 as discussed in more detail with respect to FIG. 4. If however, the linking device 38 on the replaceable printing component is not enabled to communicate with the printing system 12, then the linking device 38 waits to receive a radio frequency signal as represented in step 76.

The technique of the present disclosure has been described in terms of the linking device 38 on the replaceable printing component 14 being enabled or disabled from responding to a radio frequency signal. Alternatively, a linking device 38 can respond with a radio frequency signal whether disabled or not but the data provided by the linking device 38 can be different if the linking device is not enabled from when it is enabled. The electronic surveillance system 72 then determines whether the linking device 38 was enabled based on the data provided by the linking device 38.

The technique of the present disclosure makes use of a linking device 38 that is capable of communicating with not only the printing system 12 for transferring information there between but is also capable of communicating with various electronic surveillance systems 72 for identifying theft of the replaceable printing component 14. Previous solutions to preventing theft of replaceable printing components 14 were to place radio frequency tags on the outer packaging of the replaceable printing component 14. In order to defeet the surveillance system, one need only remove the electronic article surveillance tag from the outer packaging and then the replaceable printing component 14 can be removed in a concealed fashion from the retail outlet without setting off an alarm. By integrating the radio frequency tag within the linking device 38 that is mounted directly to the replaceable printing component 14 prevents one from disabling the article surveillance without removing the linking device 38 directly from the replaceable printing component 14. Removal of the linking device 38 requires that the replaceable printing component 14 be removed from its packaging. In addition, removal of the linking device 38 prevents the replaceable printing component 14 from communicating with the printing system 12 thereby preventing the printing system 12 from properly operating.

In the case where different retail stores use different surveillance systems 72 the linking device 38 is configured to respond to each of these different surveillance systems 72. When the replaceable printing component 14 is purchased at a retail store the linking device 38 is inactivated from responding to any surveillance device 72. By preventing the linking device 38 from responding to any surveillance device 72 assures that a purchase of a replaceable printing component 14 in one store will be honored by subsequent stores having different surveillance systems 72 that a customer may visit.

What is claimed is:

1. A marking engine for use in a marking machine, the marking engine responsive to control signals for selectively depositing marking material on media, the marking engine comprising:

a housing associated with the marking engine, the housing configured for docking with the marking machine; and a radio frequency linking device mounted to the housing, the radio frequency linking device configured for providing a radio frequency link for transferring information between the marking engine and each of the marking machine and theft prevention surveillance devices spaced apart from the marking machine.

2. The marking engine of claim 1 wherein the radio frequency link selectively transfers information between the marking engine and each of the marking machine and theft prevention surveillance devices without use of electrical conductors extending between the marking engine and each of the marking machine and theft prevention surveillance devices.

3. The marking engine of claim 1 wherein the radio frequency linking device includes an electrical storage device having a pair of supply terminals and wherein an electromotive force is established between the pair of supply terminals based on a presence of a radio frequency signal at the radio frequency linking device.

4. The marking engine of claim 1 wherein the marking engine is an electrophotographic marking engine.

5. The marking engine of claim 1 wherein the marking engine is an ink ejection marking engine.

6. The marking engine of claim 1 wherein the radio frequency linking device is responsive to radio frequency signals provided by the marking machine and theft prevention surveillance devices.

7. The marking engine of claim 1 wherein the marking engine is a refurbished marking engine containing a replacement marking media.

8. The marking engine of claim 1 wherein the radio frequency linking device has a surveillance enable mode wherein the radio frequency linking device is responsive to theft prevention surveillance devices and a surveillance non-enable mode wherein the radio frequency linking device is not responsive to theft prevention surveillance devices.

9. The marking engine of claim 8, wherein the surveillance enable mode is active only prior to purchase.

10. The marking engine of claim 8, wherein the surveillance non-enable mode is 1 active only after purchase.

11. The marking engine of claim 1, wherein the radio frequency linking device is configured for providing a radio frequency link for transferring information between the marking engine and only the marking machine after purchase.

12. A replaceable printing component for insertion into a printing system, the replaceable printing component comprising:

a radio frequency linking device configured for transferring information between the replaceable printing component and the printing system; and wherein the radio frequency linking device is configured for transferring information between the replaceable printing component and electronic theft prevention surveillance systems spaced apart from the printing system.

13. The replaceable printing component of claim 12 wherein the radio frequency linking device has a surveillance enable mode wherein the radio frequency linking device is responsive to theft prevention surveillance systems and a surveillance non-enable mode wherein the radio frequency linking device is not responsive to theft prevention surveillance systems.

14. The replaceable printing component of claim 13, wherein the surveillance enable mode is active only prior to purchase.

15. The replaceable printing component of claim 13, wherein the surveillance non-enable mode is active only after purchase.

16. The replaceable printing component of claim 12 wherein the replaceable printing component is an electrophotographic marking engine.

17. The replaceable printing component of claim 12 wherein the replaceable printing component is an ink ejection marking engine.

18. The replaceable printing component of claim 12 wherein the radio frequency link selectively transfers information between the replaceable printing component and each of the printing system and theft prevention surveillance systems without use of electrical conductors extending between the replaceable printing component and each of the printing system and theft prevention surveillance systems.

19. The replaceable printing component of claim 12, wherein the radio frequency linking device is configured for transferring information between the replaceable printing component and only the printing system after purchase.

20. A replaceable printing component for insertion into a printing system, the replaceable printing component comprising:

a radio frequency linking device responsive to radio frequency signals for providing a responsive radio frequency signal; and wherein the radio frequency linking device is configured to respond to each of the printing system and electronic theft prevention surveillance systems spaced apart from the printing system for transferring information between each of the printing system and electronic theft prevention surveillance systems.

21. The replaceable printing component of claim wherein the radio frequency linking device has a surveillance enable mode wherein the radio frequency linking device is responsive to theft prevention surveillance systems and, a surveillance non-enable mode wherein the radio frequency linking device is not responsive to theft prevention surveillance systems.

22. The replaceable printing component of claim 21, wherein the surveillance enable mode is active only prior to purchase.

23. The replaceable printing component of claim 21, wherein the surveillance non-enable mode is active only after purchase.

24. The replaceable printing component of claim 20 wherein the replaceable printing component is an electrophotographic marking engine.

25. The replaceable printing component of claim 20 wherein the replaceable printing component is an ink ejection marking engine.

26. The replaceable printing component of claim 20, wherein the radio frequency linking device is configured to respond to only the printing system after purchase.

27. A replaceable printing component for insertion into a printing system, the replaceable printing component comprising:

a radio frequency linking device configured for transferring information between the replaceable printing component and each of the printing system and an electronic theft prevention surveillance system spaced apart from the printing system; and a memory device configured for providing information to each of the printing system and the electronic theft prevention surveillance system.

28. The replaceable printing component of claim 27, wherein the radio frequency linking device is configured to respond to only the printing system after purchase.

* * * * *

UNITED STATES PATENT AND TRADEMARK OFFICE

CERTIFICATE OF CORRECTION

PATENT NO. : 6,739,691 B2
DATED : May 25, 2004
INVENTOR(S) : Walker

It is certified that error appears in the above-identified patent and that said Letters Patent is hereby corrected as shown below:

Column 10,
Line 41, after “is”, delete “1”.

Column 11,
Line 33, after “claim”, insert -- 20 --.

Signed and Sealed this

Twenty-second Day of February, 2005

JON W. DUDAS
*Director of the United States Patent and Trademark Office*